US009016981B2

(12) United States Patent
Kryzak

(10) Patent No.: US 9,016,981 B2
(45) Date of Patent: Apr. 28, 2015

(54) AQUATIC RECOVERY AND REPAIR SYSTEM

(76) Inventor: Thomas J. Kryzak, Altamont, NY (US)

( * ) Notice: Subject to any disclaimer, the term of this patent is extended or adjusted under 35 U.S.C. 154(b) by 0 days.

(21) Appl. No.: 13/697,354

(22) PCT Filed: May 10, 2011

(86) PCT No.: PCT/US2011/035993

§ 371 (c)(1),
(2), (4) Date: Nov. 10, 2012

(87) PCT Pub. No.: WO2011/143272

PCT Pub. Date: Nov. 17, 2011

(65) Prior Publication Data

US 2013/0058722 A1 Mar. 7, 2013

Related U.S. Application Data

(60) Provisional application No. 61/395,214, filed on May 10, 2010.

(51) Int. Cl.
*E02B 15/04* (2006.01)
*E21B 43/01* (2006.01)

(52) U.S. Cl.
CPC ..... *E21B 43/0122* (2013.01); *E02B 15/04* (2013.01)

(58) Field of Classification Search
CPC ..... E02B 15/00; E02B 15/04; E02B 15/045; E02B 15/046; E02B 15/047; E21B 43/0122; F16L 3/08; F16L 3/10; F16L 3/12; F16L 3/1211
USPC ..... 405/60, 63, 64, 184.1, 216; 138/99
See application file for complete search history.

(56) References Cited

U.S. PATENT DOCUMENTS

| | | | | | |
|---|---|---|---|---|---|
| 3,480,043 | A | * | 11/1969 | Viancour et al. | 138/99 |
| 3,496,963 | A | * | 2/1970 | Moody et al. | 138/99 |
| 3,500,841 | A | * | 3/1970 | Logan | 405/60 |
| 3,643,741 | A | * | 2/1972 | Miranda | 405/60 |
| 3,664,136 | A | * | 5/1972 | Laval et al. | 405/60 |
| 3,745,773 | A | * | 7/1973 | Cunningham | 405/60 |
| 3,924,658 | A | | 12/1975 | Lazarre et al. | |
| 3,981,154 | A | * | 9/1976 | Hix, Jr. | 405/60 |
| 4,283,159 | A | | 8/1981 | Johnson et al. | |
| 4,324,505 | A | * | 4/1982 | Hammett | 405/60 |
| 4,358,218 | A | * | 11/1982 | Graham | 405/60 |
| 4,358,219 | A | * | 11/1982 | Burns | 405/60 |
| 4,395,157 | A | * | 7/1983 | Cunningham | 405/60 |
| 4,420,400 | A | * | 12/1983 | Weitzen | 210/710 |
| 4,449,850 | A | * | 5/1984 | Cessou et al. | 405/60 |
| 4,456,071 | A | | 6/1984 | Milgram | |

(Continued)

*Primary Examiner* — Frederick L Lagman

(74) *Attorney, Agent, or Firm* — GFD Patents LLC; Gerald F. Dudding

(57) ABSTRACT

An Oil/Gas Recovery System, a Rotating Encasement Fitting (REF) and Methods of Using. The Oil/Gas Recovery System comprises a flexible shroud open at an end facing a leaking drill line arising from the bottom of a body of water, a recovery system operably coupled to the flexible shroud by an intake line, and a delivery system, operably coupled to the flexible shroud by a delivery line. The flexible shroud is adapted to be lowered or raised in a body of water, so that the open end encloses a source of crude oil or gas to be recovered. The Rotating Encasement Fitting (REF) for sealing a compromised pipeline fracture, comprises bladder glands at each end of the REF and a pipeline having a fracture therein. The bladder glands can be activated by a supply line or remotely supplied for multiple charges.

17 Claims, 6 Drawing Sheets

(56) References Cited

U.S. PATENT DOCUMENTS

| | | | | | |
|---|---|---|---|---|---|
| 4,531,860 | A | * | 7/1985 | Barnett | 405/60 |
| 4,619,762 | A | * | 10/1986 | Delacour et al. | 405/60 |
| 4,786,087 | A | * | 11/1988 | Thewlis et al. | 285/97 |
| 5,050,680 | A | | 9/1991 | Diehl | |
| 5,146,953 | A | * | 9/1992 | Bell | 138/99 |
| 5,333,916 | A | * | 8/1994 | Burkit et al. | 138/99 |
| 8,444,344 | B2 | * | 5/2013 | Oesterberg et al. | 405/60 |
| 2005/0025574 | A1 | * | 2/2005 | Lazes | 405/60 |
| 2006/0065392 | A1 | | 3/2006 | Davila | |
| 2011/0318106 | A1 | * | 12/2011 | Gateff et al. | 405/60 |
| 2013/0206421 | A1 | * | 8/2013 | De Ghetto et al. | 166/357 |

* cited by examiner

Aquatic Contamination Recovery
+ Repair System (ARRS)

ARRS

Oil/Gas Recovery
+ Repair Line System

AQUATIC RECOVERY AND REPAIR SYSTEM

FIELD OF THE INVENTION

The present invention generally teaches an Aquatic Recovery and Repair System (ARRS). More specifically, the present invention teaches an Aquatic Recovery and Repair System (ARRS) for recovery and repair of aquatic environments from oil and/or gas leaks or spills resulting from catastrophic ruptures in oil and gas exploration and drilling operations.

BACKGROUND

The possibility of oil and/or gas leaks or spills resulting from catastrophic ruptures in oil and gas exploration and drilling operations has been shown by spills in the Gulf of Mexico and other aquatic oil and gas exploration and drilling operations. The oil spill in the Gulf of Mexico flowed for three months in 2010. It is estimated that 8,400 $m^3$/day of crude oil were escaping from the well just before it was capped on Jul. 15, 2010. It is believed that the daily flow rate diminished over time, starting at about 62,000 barrels per day (9,900 $m^3$/d) and decreasing as the reservoir of hydrocarbons feeding the gusher was gradually depleted.

Traditional attempts to encapsulate the leak failed. Therefore, there is a need for improved systems and methods for containing and stopping oil and/or gas leaks or spills resulting from catastrophic ruptures in oil and gas exploration and drilling operations.

SUMMARY OF THE INVENTION

A first aspect of the present invention provides an Oil/Gas Recovery System, comprising: a flexible shroud open at an end facing a leaking drill line arising from the bottom of a body of water, the flexible shroud being adapted to be lowered or raised in a body of water, so that the open end encloses a source of crude oil or gas to be recovered; a recovery system, comprising a vacuum pump operably coupled to the flexible shroud by an intake line; and a delivery system, comprising a delivery pump operably coupled to the flexible shroud by a delivery line.

A second aspect of the present invention provides a method of using an Oil/Gas Recovery System, comprising: lowering an ELB over an oil source leak or plume, to recover oil/gas products; and vacuuming or pumping via the recovery system of the AARS the spill products to collection tankers/barges or drill rigs for pumping back to the shore.

A third aspect of the present invention provides a Rotating Encasement Fitting (REF) for sealing a compromised pipeline fracture, comprising: bladder glands at each end of the REF and a pipeline having a fracture therein, wherein the bladder glands are internal, external or both internal and external with respect to the pipeline, and wherein the bladder glands can be activated by a supply line or remotely supplied for multiple charges.

BRIEF SUMMARY OF THE FIGURES

The features of the invention are set forth in the appended claims. The invention itself, however, will be best understood by reference to the following detailed description of an illustrative embodiment when read in conjunction with the accompanying drawings, wherein:

DETAILED DESCRIPTION OF THE EMBODIMENTS OF THE INVENTION

Figure 1:
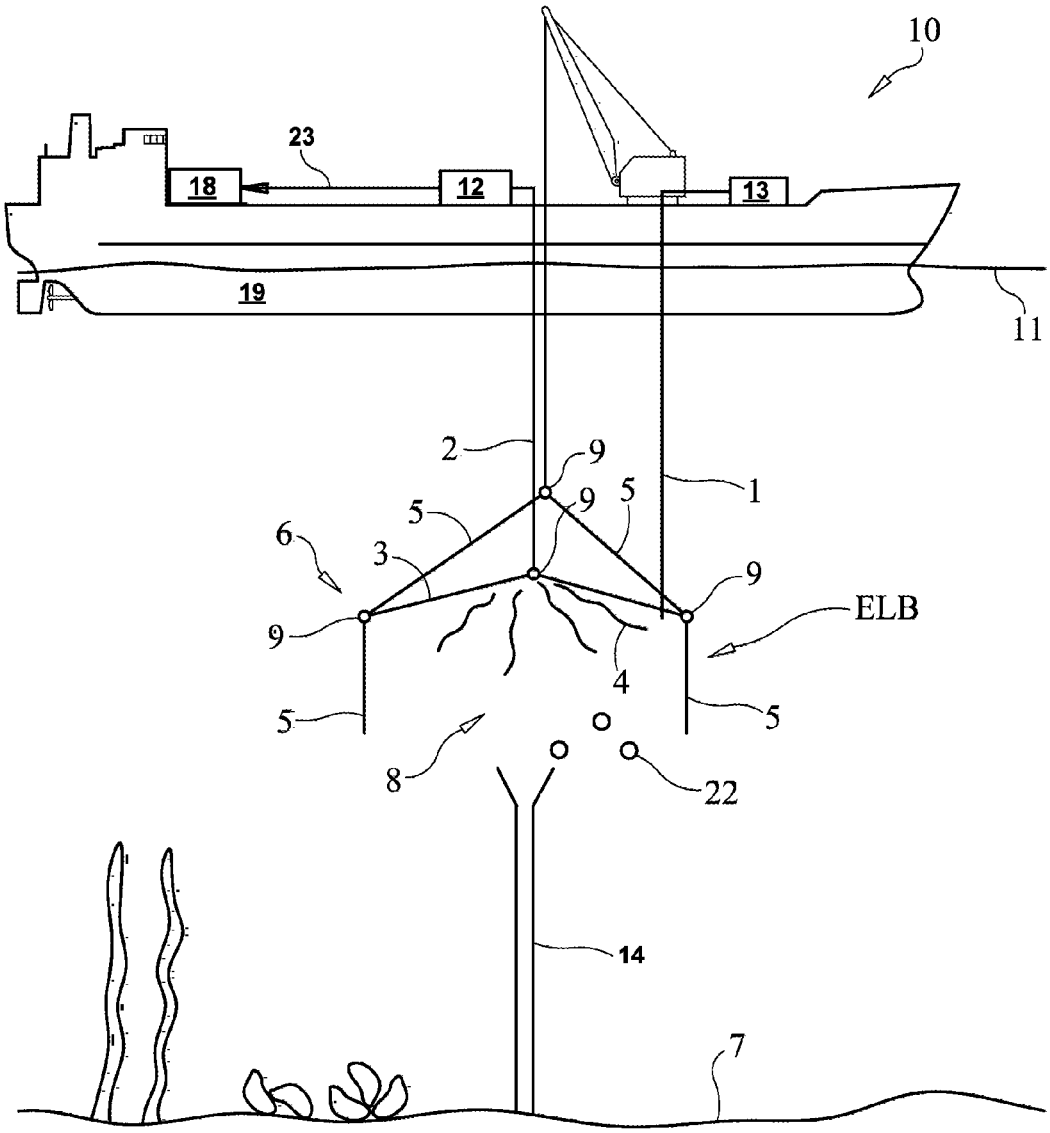
FIG. 1 depicts a front elevation view of an Aquatic Recovery and Repair System (ARRS), in accordance with embodiments of the present invention.

FIG. 1 depicts a front elevation view of an Aquatic Recovery and Repair System (ARRS) 10. The ARRS is for recovery of oil/gas/solvents and repair work. The ARRS 10 comprises: a boat/tanker/rig 19, supply and delivery line 1, recovery/vacuum line 2, and a flexible shroud 6. The flexible shroud 6 comprises an internal bladder blanket 3, a recovery/vacuum manifold 4, outer walls 5, and open end 8. Adjacent outer walls 5 may be operably coupled by joints 9 having hinged capabilities. In like manner, the internal bladder blanket 3 may be operably coupled to adjacent outer walls 5 by joints 9 having hinged capabilities.

As used herein, unless otherwise defined, the term "operably coupled" is defined as physically or mechanically connected, attached, joined or otherwise coupled.

The ARRS 10 may be suspended from support crafts for assisting in the operations, raising/lowering ARRS 10, pumping/vacuum recovery 12, delivery systems 13, for additives, enhancers, cutters, thinners, tools, equipment for viewing, filming, or lighting.

U.S. Pat. Nos. 7,264,713, 7,497,645, 7,578,248, 7,699,982, titled "Apparatus, System and Method for Remediation of Contamination", issued to Thomas J. Kryzak, are herein incorporated by reference. The ARRS 10 may be an Extraction Lunch Box (ELB) having GPS, testing capabilities, heating, cooling, mixing.

Supply and delivery line 1 can be heated or double walled.

The internal bladder blanket 3 may change size and shape with ability to flex the shape to wider or taller for responding to the amount of oil surface and depending on viscosity, depth in water, temperature of water, needed to buffer product pressure surges for product to flow well, i.e., under control to prevent product blowouts.

Shape change is accomplished by the hinged capabilities at the joint areas 9 between the walls 5 adjacent to the internal bladder blanket 3.

Heated additives, gas/air bubbles, solvents, agents, microbes, bacteria are pumped in via delivery line 1 to add to the lift to the product, e.g. crude oil or gas This also cuts the thickness and treats any product that escapes capture.

Chemical or gas filled bladder balls 22 may be pumped in via delivery line 1, independently adding to the lift and push to the surface 11.

The bladder balls 22 may be made of sponge like attracting materials or tennis like balls with extra absorbing fuzz or material that can be used as a transport vehicle may be pumped in via delivery line 1. The materials may be processed by running them through a roller press, chemical bath or a heat processes and/or presses and recycle them back into the ARRS 10 for return recovery trips.

Figure 2:
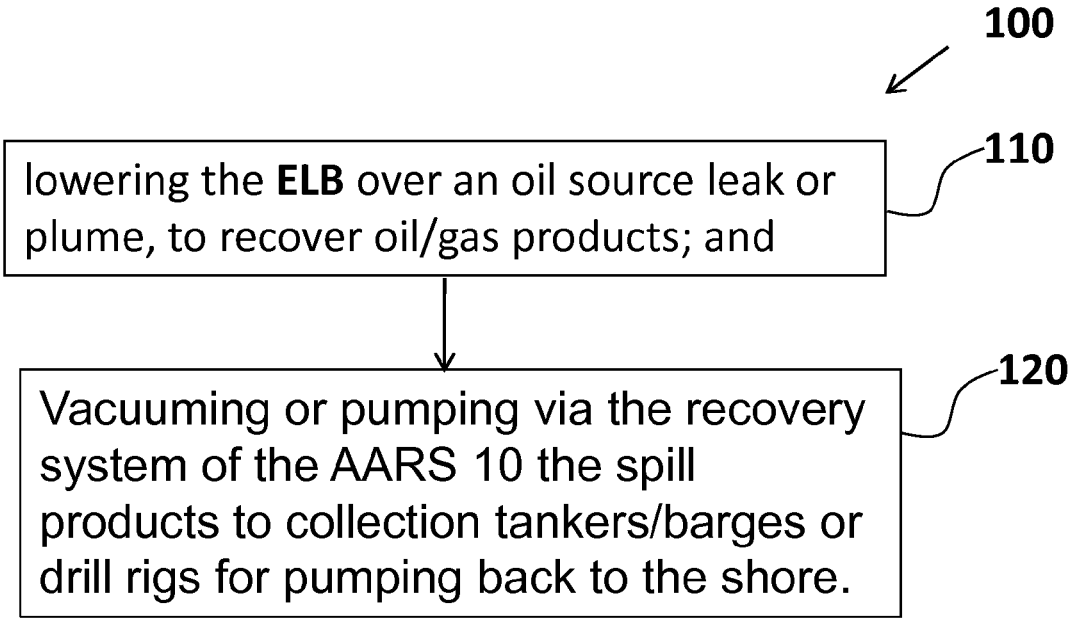
FIG. 2 depicts a flow diagram of a method 100 for using the ELB equipped with multiple service equipment, in accordance with embodiments of the present invention.

FIG. 2 depicts a flow diagram of a method 100 for using the ELB equipped with multiple service equipment. In a step 110 of the method 100, the ELB may be lowered over the oil source leak or the plume, depicted arising from the drill line 14 in FIG. 1, to recover the oil/gas products. In a step 120, the spill products can be vacuumed or pumped in a direction of the arrow 23, via the vacuum/pump system 24 of the recovery system 13 of the ARRS 10 to a collection system 18, e.g., tankers/barges or drill rigs for pumping back to the shore thru existing product lines or float lines to shore based terminals for recovery procedures. The ELB Recovery System can be deployed from buoys, tankers, barges, etc for transport to track and recover spilled product in oceans, bays, rivers and lakes, using shut off valve 25, and neck buoy/barge connection 26.

The ELB has the capacity for multiple piping schemes for recovery and delivery in and out of the unit using solvents, gases, coagulants, inhibitors, etc.

A burn off vent can be incorporated into the recovery process.

Figure 3A:
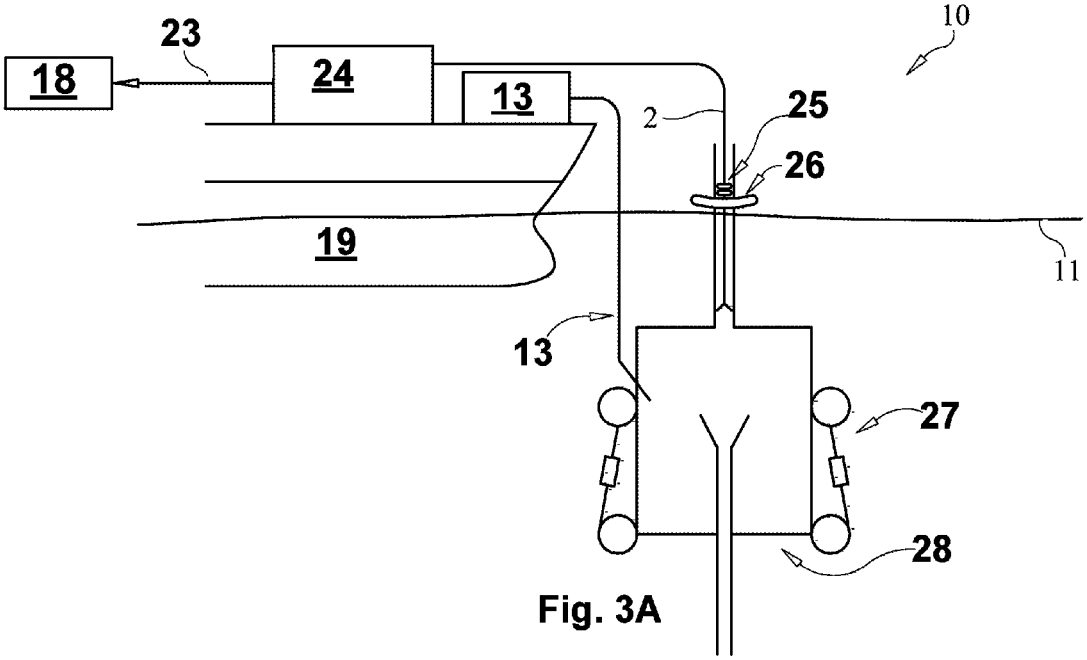
FIGS. 3A-3B depict a longitudinal cross-sectional view of the delivery system depicted in FIG. 1, further comprising swing gates, in accordance with embodiments of the present invention.
Figure 3B:
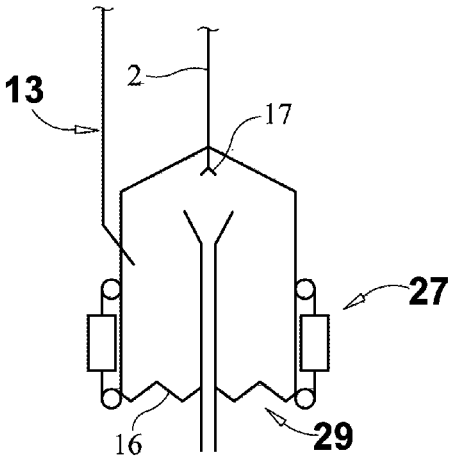

FIGS. 3A and 3B depict oils can be tracked thru out the water column between the surface 11 and the bottoms 7 and be recovered using the ELB's multiple features. The oil recovery can be enhanced by use of the augers, whips, pumps, props, injectors, nozzles, impellers within the ELB and piping recovery system, described in U.S. Pat. No. 7,264,713, column 15, lines 1-28, and in FIG. 2A, herein incorporated by reference.

FIG. 3A depicts a longitudinal cross-sectional view of the delivery system depicted in FIG. 1, further comprising swing gates 28 designed to close in around the source of the oil/gas leaks, e.g. the drill line 14. In one embodiment, the ELB comprises swing gates with movable ends that rotate, bend, flex toward the centerline designed to close in around the source of the oil/gas leaks, e.g. the drill line 14.

FIG. 3B, in one embodiment, depicts the ELB comprises accordion swing gates 29 with movable ends that rotate, bend, flex toward the centerline designed to close in around the source of the oil/gas leaks, e.g. the drill line 14.

Additives, e.g. gases can be pumped into the ELB through the delivery system 13 via delivery line 1 to assist in the "lift effort" in recovering the oil/gas spilled. Alternatively, fluids, e.g., solvents, or catalysts, or retardants, e.g. retardant gases can be pumped into the ELB through the delivery system 13 via delivery line 1 to aid in collecting (and transporting) the spill products.

Alternatively, an array of "sealing slurry" can be pumped into the ELB through the delivery system via delivery line 1 to aid in sealing around the drill line 14 at 15. Alternatively, bladder units 16 may be activated by charging delivery line 1 with "sealing slurry" or pre-loaded bladder units 16 may be activated to release their "sealing slurry" remotely. Double acting cylinders 27 may recharge bladder units 16 with "sealing slurry", in place at connector points or additional bladder units 16 can be attached to the flexible shroud 6 and filled to double up the seal point 15.

Use a recovery line with a flared/expanded end 17 flared over the oil/gas source, e.g. the drill line 14, or as close as possible to a damaged pipeline to collect and recover the oil and/or gas.

Figure 4:
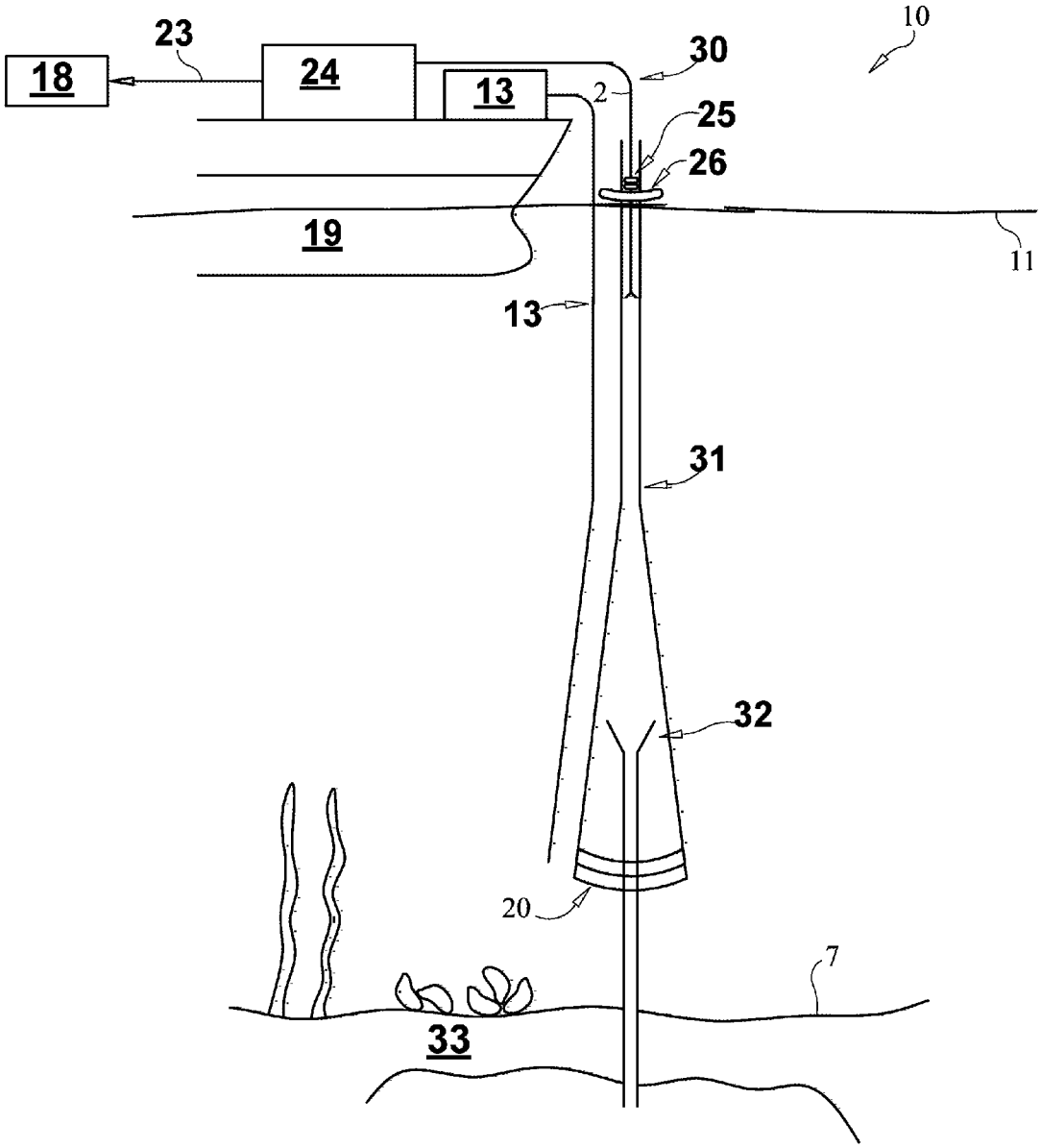
FIG. 4 depicts a longitudinal cross-sectional view of the ARRS 10, in which the recovery system may have expanding glands, in accordance with embodiments of the present invention.

FIG. 4 depicts a longitudinal cross-sectional view of the ARRS 10, in which the recovery system may have expanding glands 20 that can be filled with multiple mixes and/or combinations of air, gases, fluids and slurry media and/or expressing out of the glands filling (any) voids. The glands expand to limit the space between the recovery system and the damaged line. This limits the exchange of oil/gas and the surrounding water.

In one embodiment is depicted one way of operably coupling the external delivery system to the expanding glands 20 at the base of the ARRS 10. The glands 20 can be supplied by an internal line remotely by subs, etc.

Glands 20 are positioned inside, outside or a combination of, thru the wall jacket of the ARRS 10.

Glands 20 can be activated and filled with soft or hard materials or a combination of and it can stay soft or harden rigid like cement.

The slurry media may remain soft, flexible or engineered to harden to a solid.

The valve position 22 is shown below the water line 11 allowing segmented pipe to be added to able to have different elevations.

A vac/pump/skimmer system may be used in recovery of oil/gas (solvents) and compromised waters.

A shutoff device such as a valve may be installed (and activated) to contain the oil/gas/water mix (after the seal is in place).

A flotation buoy, e.g., a neck buoy, operably coupled to the floating vessel or rig may be used to stabilize the recovery system.

The recovered mix may be sent to tankers or use a piping system for transport to a recovery area.

Figure 5:
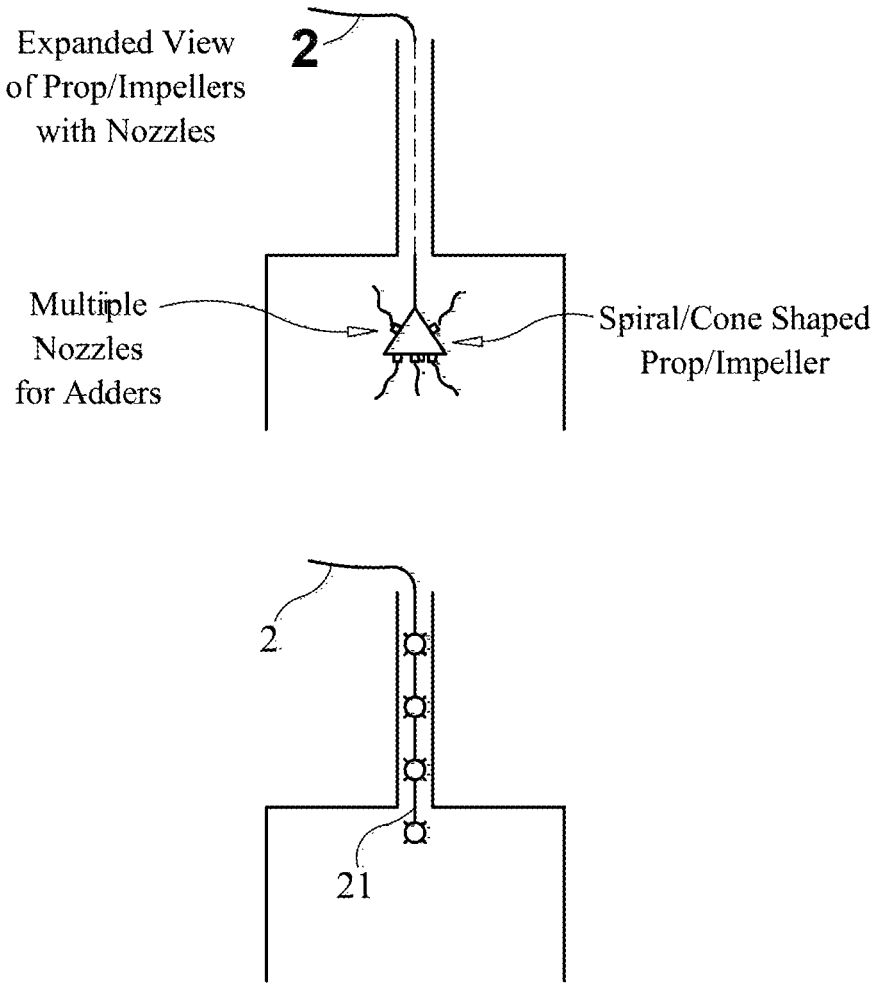
FIG. 5 depicts a longitudinal cross-sectional view of the ARRS 10, showing an internal multi-purpose line (MPL), in accordance with embodiments of the present invention.

FIG. 5 depicts a longitudinal cross-sectional view of the ARRS 10, showing an internal multi-purpose line (MPL) that powers for example a spiral/cone shaped prop/impeller capable of vac, pumping or mixing.

The MPL's cone/spiral impellers have inlets and outlets; Nozzles to deliver additives and/or sites for withdraws thru the MPL for product recovery.

The ARRS can have multiple mainline attachment sites on the unit varying in size and diameter, leading to the surface or laying on the sea bottoms and traveling to rigs or shoreline sites.

In one embodiment, several independent cone Impeller (CI) systems 21 acting in unison help "step lift" the product thru the riser simultaneously injecting adders and/or vac/pumping for recovery to the surface or thru its own internal recovery system via recovery/vacuum line 2.

The CI's 21 can be staggered or stacked close together for heavy material lifts.

Not shown is the spiral impeller (SI) system acting like a screw conveyor transport system that is flexible, rigid or a combination capable of moving light product to thick almost solid product.

Figure 6:
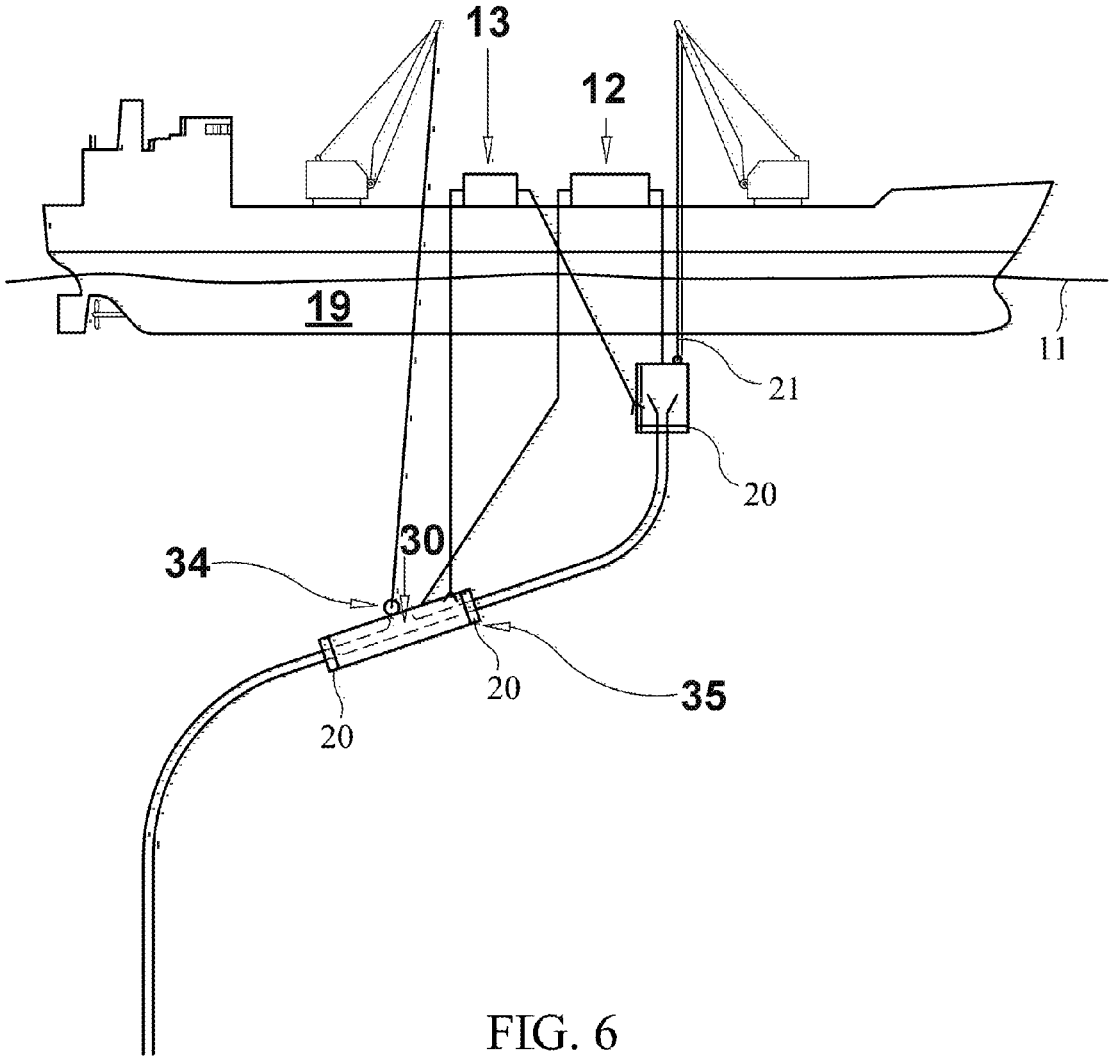
FIG. 6 depicts a longitudinal cross-sectional view of the ARRS 10, comprising a Rotating Encasement Fitting (REF) assembly surrounding a compromised pipeline fracture, in accordance with embodiments of the present invention.

FIG. 6 depicts a longitudinal cross-sectional view of the ARRS 10, comprising a Rotating Encasement Fitting (REF) assembly surrounding a compromised pipeline fracture.

It has bladder glands at each end that are internal, external or both that can be activated by a supply line or remotely supplied for multiple charges.

The REF can be slid over the pipeline at the surface and lowered into position or it can be applied at the specific damaged site.

The REF may be formed, as 2 pieces, as one continuous piece or as a half REF piece surrounded by a jacket wrap that rotates around the pipe and meets the initial half REF piece and forms a sealed unit.

The Jacket wrap REF is operated by mechanical means (hydraulic, air or manual) to follow a curved projection around the pipeline.

Then the REF unit can activate the sealing glands 20 and shut off the spill.

The REF can also be equipped with service lines leading internally to act as a supply/extract line or as a tool delivery mechanism.

The foregoing description of the embodiments of this invention has been presented for purposes of illustration and description. It is not intended to be exhaustive or to limit the invention to the precise form disclosed, and obviously, many modifications and variations are possible. Such modifications and variations that may be apparent to a person skilled in the art are intended to be included within the scope of this invention as defined by the accompanying claims.

I claim:

1. An oil/gas recovery system, comprising:

a suspended isolation vessel, comprising a flexible shroud open at an end facing a leaking drill line arising from the bottom of a body of water, the isolation vessel being adapted to be lowered or raised in a body of water, so that the open end encloses a source of crude oil or gas to be recovered, wherein adjacent outer walls of the flexible shroud are operably coupled to an internal bladder blanket by joints having hinged capabilities;

a recovery system, comprising a vacuum pump operably coupled to the flexible shroud by an intake line; and a delivery system, comprising a delivery pump operably coupled to the flexible shroud by a delivery line.

2. The oil/gas recovery system of claim 1, wherein the flexible shroud is made of a material selected from the group consisting of solvent resistant plastic sheet, metal sheet, a metal alloy sheet, and aluminum sheet.

3. The oil/gas recovery system of claim 1, wherein the flexible shroud comprises an internal bladder blanket, a recovery/vacuum manifold, outer walls, and open end.

4. The oil/gas recovery system of claim 3, wherein the internal bladder blanket changes size and shape with ability to flex the shape to wider or taller for responding to the amount of oil surface and depending on viscosity, depth in water, temperature of water, needed to buffer product pressure surges for product to flow under control to prevent product blowouts.

5. The oil/gas recovery system of claim 4, wherein shape change of the internal bladder blanket is accomplished by the hinged capabilities at the joint areas between the walls adjacent to the internal bladder blanket.

6. The oil/gas recovery system of claim 1, comprising a heated or double walled supply and delivery line between the recovery system and the flexible shroud.

7. The oil/gas recovery system of claim 1, comprising a delivery line between the delivery system and the flexible shroud, through which heated additives, gas/air bubbles, solvents, agents, microbes, bacteria are pumped to add to a lift of a product recovered by the oil/gas recovery system.

8. The oil/gas recovery system of claim 7, wherein chemical or gas filled bladder balls are pumped in via the delivery line, independently adding to the lift and push to the surface of the body of water.

9. The oil/gas recovery system of claim 8, wherein the bladder balls are made of sponge like attracting materials or tennis like balls with extra absorbing fuzz or material that can be used as a transport vehicle.

10. The oil/gas recovery system of claim 8, wherein the bladder balls are recyclable.

11. The Oil/Gas Recovery System of claim 7, wherein the product is selected from the group consisting of oil, gas, and solvents.

12. The oil/gas recovery system of claim 1, wherein the flexible shroud comprises swing gates designed to close in around a source of the oil/gas leaks.

13. The oil/gas recovery system of claim 12, wherein the swing gates have movable ends that rotate, bend, flex toward the centerline designed to close in around the source of the oil/gas leaks.

14. The oil/gas recovery system of claim 1, wherein ruptures in the recovery system, including the source of oil/gas leaks, are wrapped by expanding glands, wherein the expanding glands are filled with multiple mixes and/or combinations of air, gases, fluids and slurry media and/or expressing out of the glands filling voids.

15. A method of using an oil/gas recovery system, comprising:

lowering the oil/gas recovery system of claim 1 over an oil source leak or plume, to recover oil/gas products; and vacuuming or pumping via the recovery system spill products to collection tankers/barges or drill rigs for pumping back to the shore.

16. The method of claim 15, comprising pumping an array of sealing slurry through the delivery system via a delivery line between the delivery system and the flexible shroud to aid in sealing around the drill line.

17. The method of claim 15, comprising activating bladder units by charging a delivery line with sealing slurry or activating pre-loaded bladder units to release their sealing slurry remotely.

* * * * *